US011840065B2

(12) United States Patent
Sakai

(10) Patent No.: US 11,840,065 B2
(45) Date of Patent: Dec. 12, 2023

(54) INKJET PRINTER

(71) Applicant: Roland DG Corporation, Hamamatsu (JP)

(72) Inventor: Chihiro Sakai, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 844 days.

(21) Appl. No.: 16/751,263

(22) Filed: Jan. 24, 2020

(65) Prior Publication Data

US 2020/0238732 A1 Jul. 30, 2020

(30) Foreign Application Priority Data

Jan. 25, 2019 (JP) ..... 2019-011108

(51) Int. Cl.

| | |
|---|---|
| ***B41J 11/00*** | (2006.01) |
| ***B41J 15/04*** | (2006.01) |
| ***B41J 11/057*** | (2006.01) |
| ***B41J 11/70*** | (2006.01) |
| ***B65H 35/04*** | (2006.01) |
| ***B65H 29/20*** | (2006.01) |

(52) U.S. Cl.

CPC ..... *B41J 11/057* (2013.01); *B41J 11/706* (2013.01); *B65H 29/20* (2013.01); *B65H 35/04* (2013.01); *B65H 2404/182* (2013.01)

(58) Field of Classification Search

CPC ..... B41J 11/057; B41J 11/706; B41J 11/045; B41J 11/0085; B41J 15/04; B41J 15/046; B65H 29/20; B65H 35/04; B65H 2404/182; B65H 2701/11312; B65H 5/224

See application file for complete search history.

(56) References Cited

U.S. PATENT DOCUMENTS 5,124,728 A * 6/1992 Denda ..... B41J 11/0085 347/108
5,951,181 A * 9/1999 Hierro ..... B41J 11/005 271/264

(Continued)

FOREIGN PATENT DOCUMENTS

JP 10035186 A * 2/1998
JP 2001294360 A * 10/2001

(Continued)

*Primary Examiner* — Luis A Gonzalez
(74) *Attorney, Agent, or Firm* — KEATING & BENNETT, LLP

(57) ABSTRACT

A printer includes a platen on which a recording medium is placed, an ink head including a nozzle that discharges ink onto the recording medium placed on the platen and that moves in a main scanning direction, an upstream guide located on an upstream side of the platen in a secondary scanning direction and that guides the recording medium, the upstream guide including an upper surface tilted obliquely downward from a downstream side to the upstream side in the secondary scanning direction, and grit rollers provided in the platen and that move the recording medium in the secondary scanning direction. The upstream guide is recessed from the upper surface of the upstream guide, and includes a concave recess that indicates a position of each of the grit rollers in the main scanning direction so that a position of the grit roller is easily acknowledged when the recording medium is placed on the platen.

6 Claims, 8 Drawing Sheets

(56) References Cited

U.S. PATENT DOCUMENTS

| | | | | |
|---|---|---|---|---|
| 6,386,536 | B1 * | 5/2002 | Juan | B41J 11/06 269/21 |
| 2019/0030932 | A1 | 1/2019 | Takenouchi | |
| 2019/0306356 | A1 * | 10/2019 | Watanabe | H04N 1/00602 |

FOREIGN PATENT DOCUMENTS

| | | | |
|---|---|---|---|
| JP | 2002-254737 | A | 9/2002 |
| JP | 2013-052577 | A | 3/2013 |
| JP | 2013-052578 | A | 3/2013 |
| JP | 2017-189963 | A | 10/2017 |
| JP | 2018-034412 | A | 3/2018 |
| JP | 2018-122433 | A | 8/2018 |
| JP | 6426801 | B1 | 11/2018 |

* cited by examiner

INKJET PRINTER

CROSS REFERENCE TO RELATED APPLICATIONS

This application claims the benefit of priority to Japanese Patent Application No. 2019-011108 filed on Jan. 25, 2019. The entire contents of this application are hereby incorporated herein by reference.

BACKGROUND OF THE INVENTION

1. Field of the Invention

The present invention relates to an inkjet printer.

2. Description of the Related Art

An inkjet printer (hereinafter may simply be referred to as a printer) that includes a platen on which a recording medium is placed; an ink head that discharges ink onto the recording medium placed on the platen; and a grit roller that conveys the recording medium, has conventionally been known. For a printer for which the recording medium has a relatively large size, a worker has to place the recording medium on the platen before printing. In the case in which the recording medium is not placed at an appropriate position, the grit roller may not be able to appropriately move the recording medium. Thus, the worker has to place the recording medium on the platen with utmost care.

For example, in JP-A-2002-254737, a printer, which is provided with marks used to position a front end and a lateral end of the recording medium, is disclosed. With such a printer, when the front end and a right end of the recording medium are placed in alignment with the marks, oblique feeding of the recording medium can be prevented.

In the case of a relatively large-sized printer, the recording medium may be inserted into the printer by placing the recording medium on the platen from a back side of the printer. In such a case, when the recording medium is placed on the platen, the recording medium also has to be placed on the grit roller. However, depending on the printer, a clearance between the platen and a member for holding a carriage, on which the ink head is mounted, has to be reduced from a perspective of securing stability and safety of the carriage. Thus, it may be difficult to check a position of the grit roller from the back side of the printer. For this reason, a worker has to use his/her experience and hunch to estimate the position of the grit roller when placing the recording medium on the platen. In the case in which the recording mediums have the same size, as disclosed in JP-A-2002-254737, the lateral end of the recording medium only needs to be placed in alignment with the mark. However, recording mediums come in a variety of sizes. Thus, when the recording medium is simply placed in alignment with the mark, the recording medium may not appropriately be placed on the grit roller.

SUMMARY OF THE INVENTION

Preferred embodiments of the present invention provide printers with each of which it is possible to easily acknowledge a position of a grit roller when a recording medium is placed on a platen thereof.

A printer according to a preferred embodiment of the present invention includes a platen that receives a recording medium placed thereon and includes an upper surface that is flat or substantially flat; an ink head including a nozzle that discharges ink onto the recording medium placed on the platen and that moves in a main scanning direction; a guide located on an upstream side of the platen in a secondary scanning direction that is perpendicular to the main scanning direction and that guides the recording medium, the guide including an upper surface tilted obliquely downward from a downstream side to the upstream side in the secondary scanning direction; and a grit roller located in the platen and that moves the recording medium placed on the platen in the secondary scanning direction. The guide includes a concave recess that is recessed from the upper surface of the guide and indicates a position of the grit roller in the main scanning direction.

According to a preferred embodiment of the present invention, the concave recess is located on the upper surface of the guide located on an upstream side of the platen in the secondary scanning direction. Here, the concave recess indicates the position of the grit roller in the main scanning direction. Thus, even in the case in which the position of the grit rollers cannot directly be recognized visually, a worker checks a position of the concave recess and is able to recognize the position of the grit roller easily. In this way, the worker is able to reliably place the recording medium on the grit roller. In addition, the concave recess is recessed from the upper surface of the guide. Thus, in the case in which the recording medium moves from the upstream side to the downstream side in the secondary scanning direction on the upper surface of the guide, or in the case in which the recording medium moves from the downstream side to the upstream side in the secondary scanning direction on the upper surface of the guide, a front end or a rear end of the recording medium does not become stuck on the concave recess. Thus, smooth movement of the recording medium is not hindered.

Preferred embodiments of the present invention provide printers with which it is possible to easily acknowledge the position of the grit roller when the recording medium is placed on the platen thereof.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
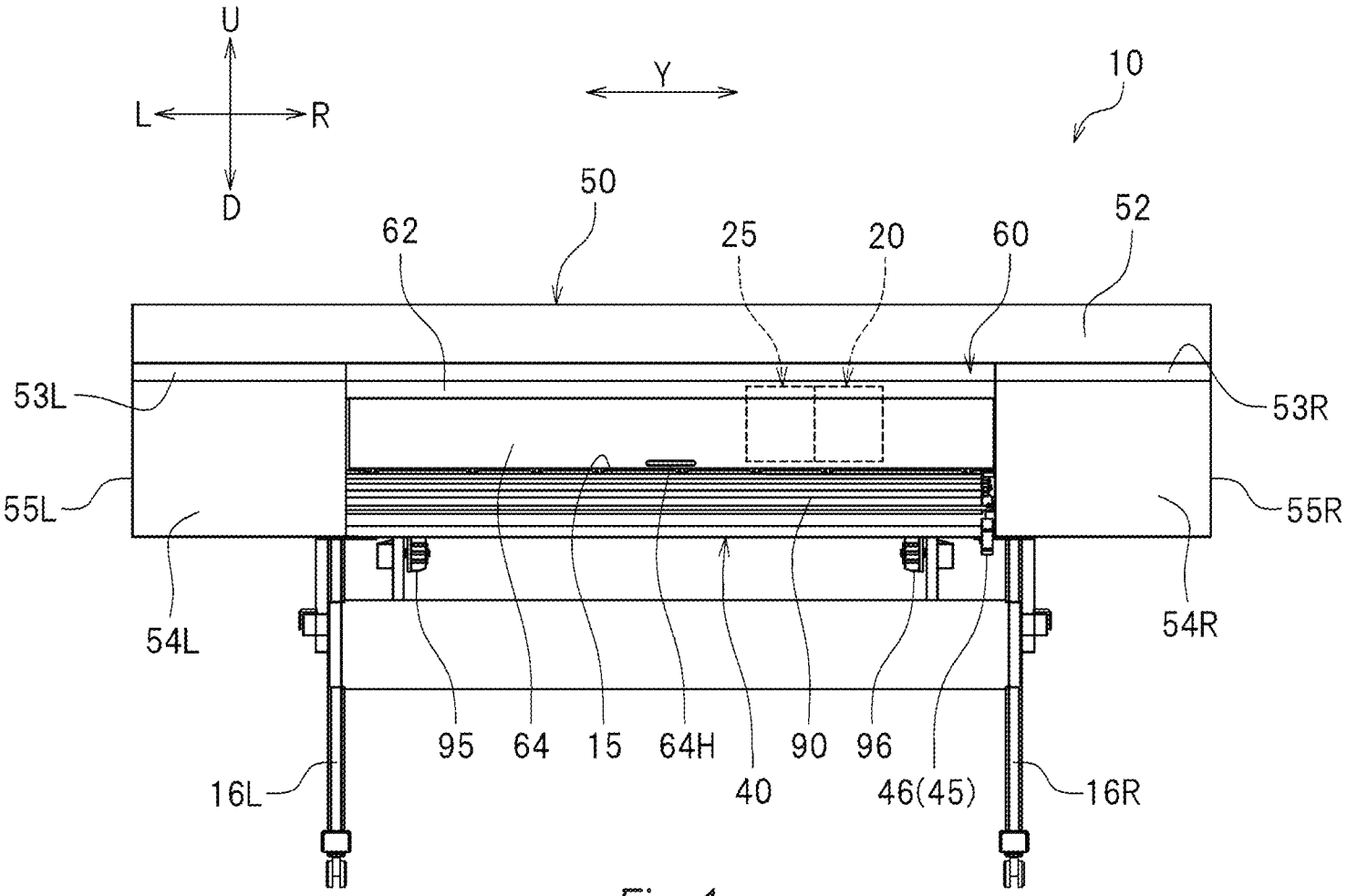
FIG. 1 is a front view of a printer according to a preferred embodiment of the present invention.

A description will hereinafter be made of printers according to preferred embodiments of the present invention with reference to the drawings. A printer according to a preferred embodiment of the present invention is preferably an inkjet printer 10 (hereinafter referred to as a printer 10), for example, that includes a cutting head and is able to print and cut a recording medium 5. The preferred embodiments described herein are not to be considered to limit the present invention to the preferred embodiments. Elements and portions having the same operational effects will be denoted by the same reference numerals, and overlapping description thereof will appropriately be omitted or simplified.

In the following description, left, right, up, and down respectively refer to left, right, up, and down as seen by a worker present on a front side of the printer 10. In addition, a near side of the printer 10 from the worker will be referred to as the front side, and a far side of the printer 10 from the worker will be referred to as a rear side. The reference symbols F, Rr, L, R, U, and D in the drawings respectively indicate front, rear, left, right, up, and down. The reference symbol Y in the drawings indicates a main scanning direction. In the present preferred embodiment, the main scanning direction Y is a lateral direction. The reference symbol X in the drawings indicates a secondary scanning direction. The secondary scanning direction X is a direction that crosses the main scanning direction Y (for example, in a perpendicular direction in a plan view). In the present preferred embodiment, the secondary scanning direction X is a longitudinal direction. Furthermore, the rear side of the printer 10 will be referred to as an upstream side, and the front side of the printer 10 will be referred to as a downstream side. Note that each of the above directions is merely defined as a matter of convenience and should not be interpreted in a restrictive manner.

The recording medium 5 is elongated and wound in a roll shape for use, for example. Alternatively, the recording medium 5 may have a sheet shape in which the recording medium 5 wound in the roll shape is cut at a specified length. The recording medium 5 is recording paper, for example. However, the recording medium 5 is not limited to recording paper. Examples of the recording medium 5 include sheets made of a resin material such as polyvinyl chloride (PVC) or polyester, a sealing material including a mat board and a paper liner stacked on the mat board and applied with an adhesive, a metal sheet made of aluminum, iron, or the like, a glass sheet, and a wooden sheet, for example. In the present specification, "cut" and "cutting" indicate a case in which the entire recording medium 5 is cut in a thickness direction (for example, a case in which both of the mat board and the paper liner of the sealing material are cut) and a case in which only a portion of the recording medium 5 is cut in the thickness direction (for example, a case in which the mat board of the sheet material is not cut but only the paper liner is cut).

Figure 2:
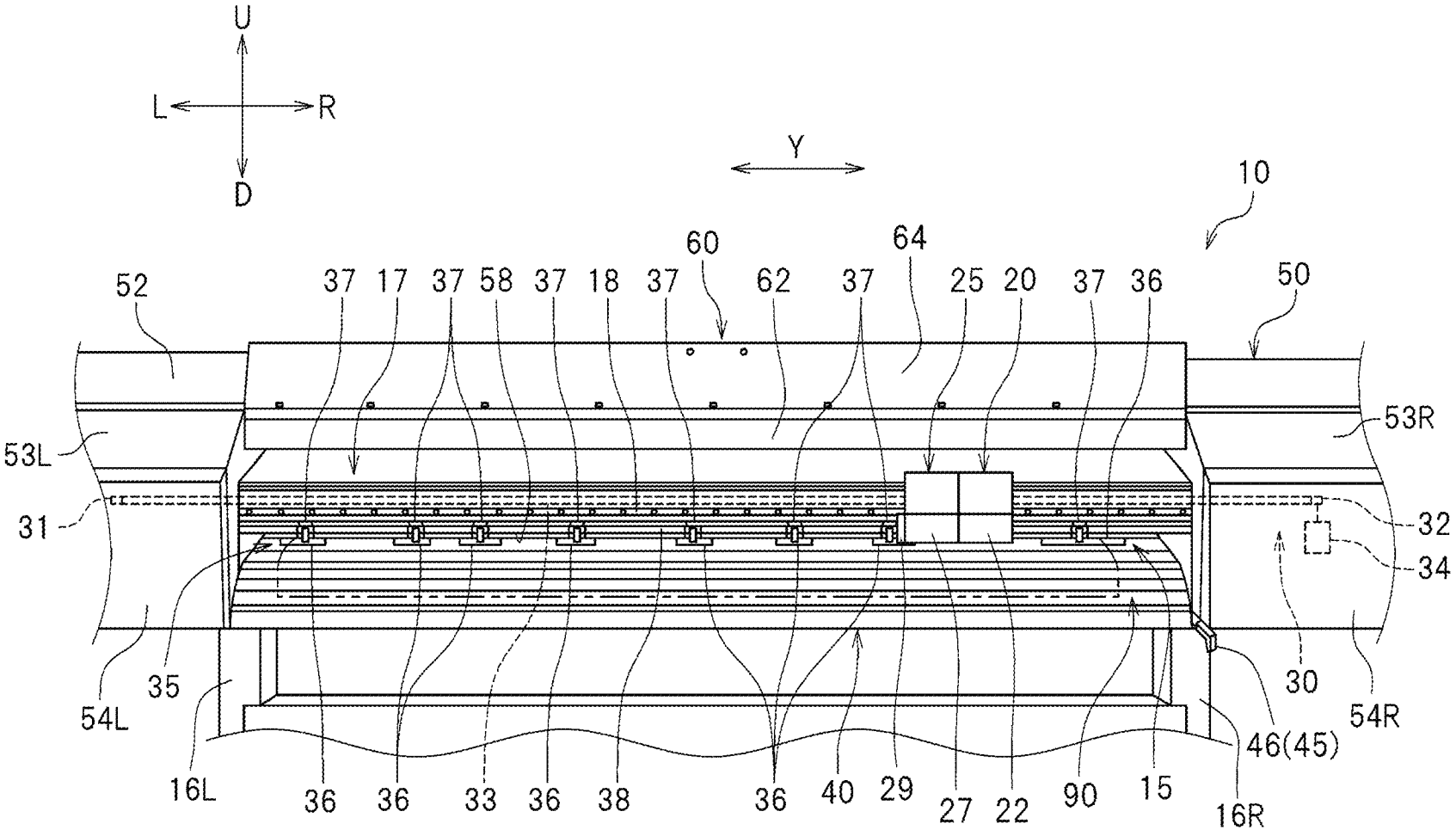
FIG. 2 is a partial front view of the printer according to a preferred embodiment of the present invention.

As shown in FIG. 1, the printer 10 includes a base 40, a platen 15 on which the recording medium 5 is placed, a body case 50, a right leg 16R, a left leg 16L, an ink head unit 20 (also see FIG. 2), and a cutting head unit 25 (also see FIG. 2). The right leg 16R and the left leg 16L are attached to a lower portion of the base 40. The right leg 16R and the left leg 16L support the base 40. The base 40 extends in the main scanning direction Y.

As shown in FIG. 1, the body case 50 is attached to the base 40. The body case 50 includes an upper wall 51 (see FIG. 3), a front wall 52, a front left wall 53L, a front right wall 53R, a front left cover 54L, a front right cover 54R, a left side wall 55L, a right side wall 55R (also see FIG. 3), and a rear wall 56 (see FIG. 3).

Figure 3:
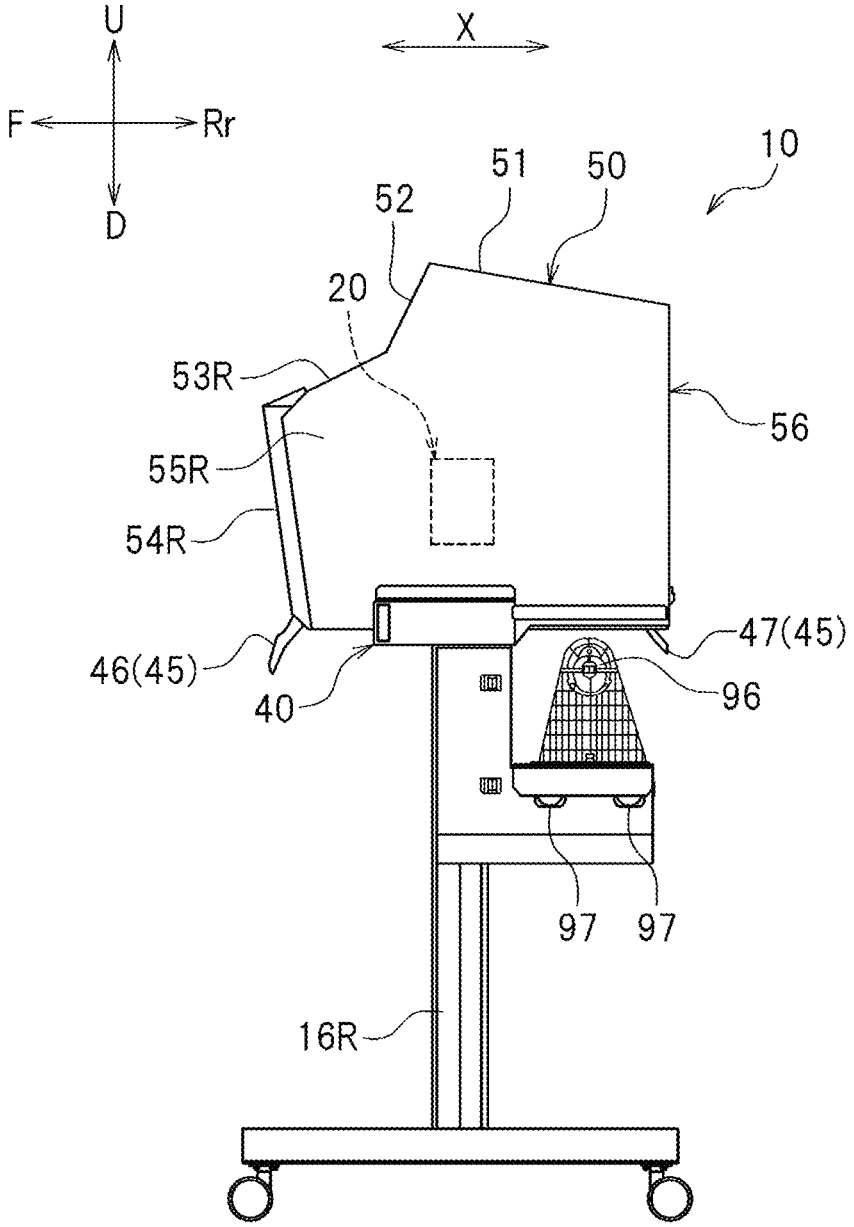
FIG. 3 is a side view of the printer according to a preferred embodiment of the present invention.

The upper wall 51 extends in the main scanning direction Y. As shown in FIG. 3, the upper wall 51 is located above the base 40. The upper wall 51 is located above the ink head unit 20. The upper wall 51 is tilted upward from an upstream side to a downstream side in the secondary scanning direction X. That is, the upper wall 51 is tilted upward from the rear side to the front side. The front wall 52 extends obliquely downward to the front from a front end of the upper wall 51. The front wall 52 extends in the main scanning direction Y.

As shown in FIG. 1, the front left wall 53L extends obliquely downward to the front from a front end of a left end region of the front wall 52. The front right wall 53R extends obliquely downward to the front from a front end of a right end region of the front wall 52. The front right wall 53R is openable/closable about a rear end of the front right wall 53. When the front right wall 53R is opened, an operation panel (not shown) is exposed to the outside.

As shown in FIG. 1, the front left cover 54L extends downward from a front end of the front left wall 53L. The front left cover 54L is openable/closable about the front end of the front left wall 53L. The front left cover 54L is located on a left side of the platen 15. The front right cover 54R extends downward from a front end of the front right wall 53R. The front right cover 54R is openable/closable about the front end of the front right wall 53R. The front right cover 54R is located on a right side of the platen 15.

As shown in FIG. 1, the left side wall 55L connects a left end of the upper wall 51, a left end of the front wall 52, a left end of the front left wall 53L, a left end of the front left cover 54L, and a left end of the rear wall 56. The right side wall 55R connects a right end of the upper wall 51, a right end of the front wall 52, a right end of the front right wall 53R, a right end of the front right cover 54R, and a right end of the rear wall 56.

Figure 4:
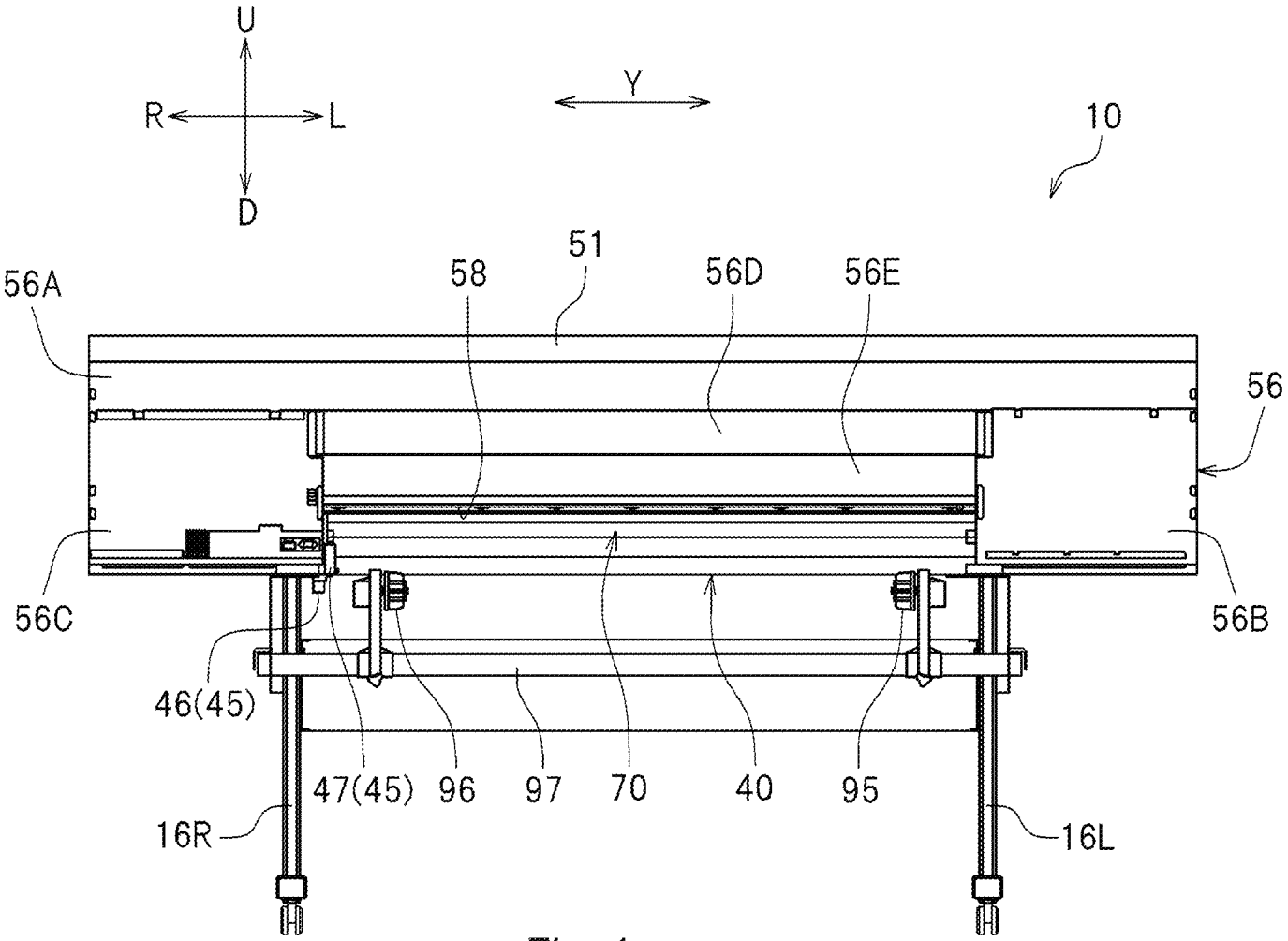
FIG. 4 is a rear view of the printer according to a preferred embodiment of the present invention.

As shown in FIG. 4, the rear wall 56 includes an upper rear wall 56A, a lower left rear wall 56B, a lower right rear wall 56C, an upper rear central wall 56D, and a lower rear central wall 56E. The upper rear wall 56A is located under a rear end of the upper wall 51. The lower left rear wall 56B is located at a position opposing the front left cover 54L (see FIG. 1). The lower right rear wall 56C is located under a right portion of the upper rear wall 56A. The lower right rear wall 56C is located at a position opposing the front right cover 54R (see FIG. 1). The upper rear central wall 56D extends downward from a lower end of a central portion of the upper rear wall 56A. The lower rear central wall 56E is located under the upper rear central wall 56D. The upper rear central wall 56D and the lower rear central wall 56E are located between the lower left rear wall 56B and the lower right rear wall 56C. The upper rear central wall 56D and the lower rear central wall 56E are located above the platen 15. A clearance 58 (see FIG. 2) through which the recording medium 5 is able to pass is provided between the lower rear central wall 56E and the platen 15.

As shown in FIG. 1, the printer 10 includes a front cover 60. The front cover 60 is rotatable about a front end of the front wall 52. The front cover 60 includes a frame 62 and a cover 64. The frame 62 supports the front cover 60 in such a manner as to allow rotation thereof with respect to the body case 50. The frame 62 extends in the main scanning direction Y in such a manner as to correspond to an opening width of the body case 50. The frame 62 may be made of a metal material, for example. The cover 64 opens/closes the clearance 58 (see FIG. 2) provided between the body case 50 and the platen 15. The cover 64 extends downward from the frame 62. A material of the cover 64 is not particularly limited as long as light is able to pass through the material of the cover 64. In the present preferred embodiment, the cover 64 is made of a transparent acrylic resin, for example. Through the cover 64, the worker is able to check a printing state, a cutting state, and the like. The cover 64 is provided with a handle 64H. When the worker pulls the handle 64H, the front cover 60 is opened.

As shown in FIG. 2, the printer 10 includes a central wall 17 that extends in the main scanning direction Y and the vertical direction. The central wall 17 is supported by the base 40. The central wall 17 is located above the platen 15. The clearance 58 through which the recording medium 5 passes is provided between the central wall 17 and the platen 15. The central wall 17 is accommodated in the body case 50.

As shown in FIG. 2, the printer 10 includes a guide rail 18. The guide rail 18 extends in the main scanning direction Y. The guide rail 18 is provided on the central wall 17. The guide rail 18 is located above the platen 15.

Figure 5:
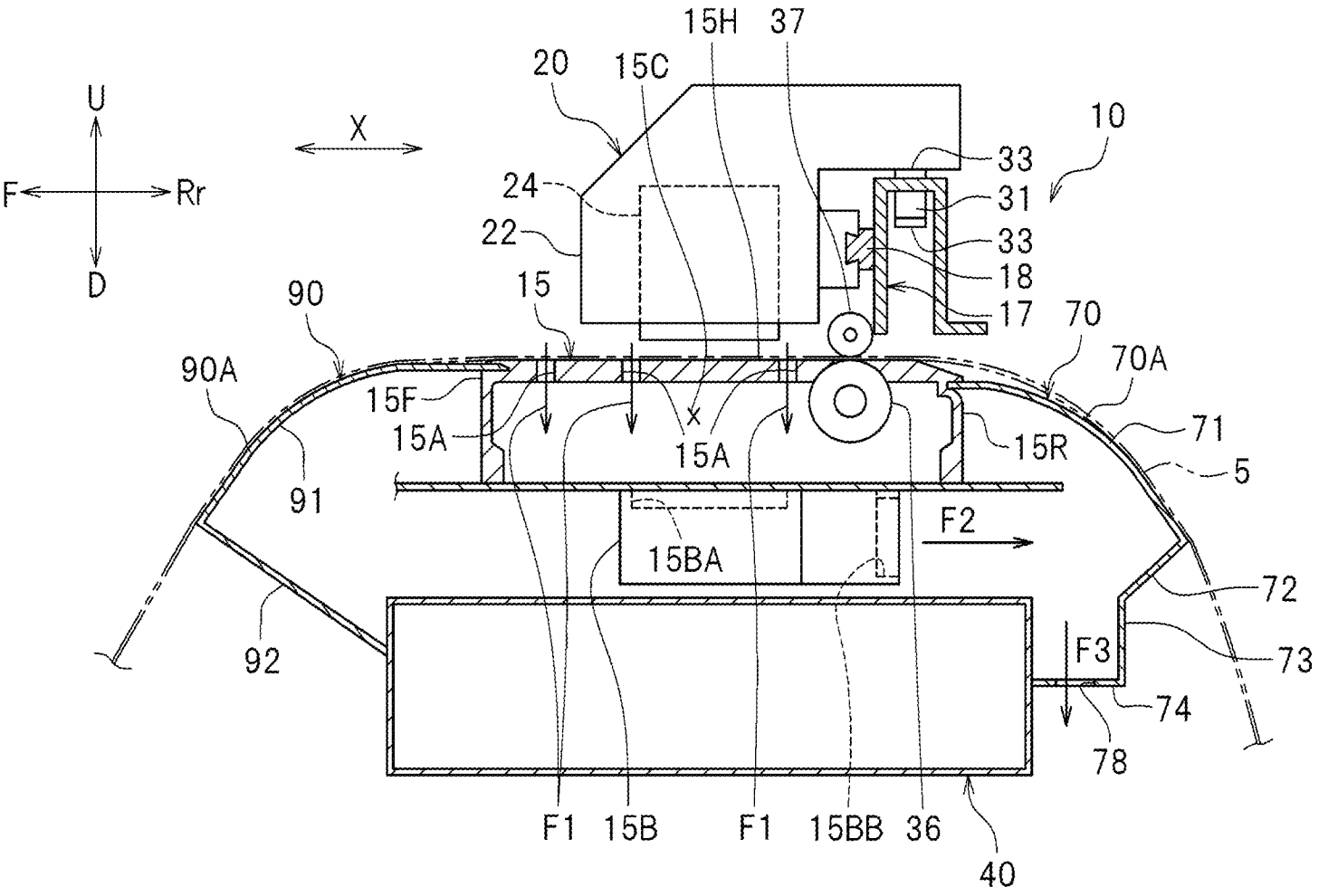
FIG. 5 is a partial cross-sectional view of the printer according to a preferred embodiment of the present invention.

As shown in FIG. 2, the ink head unit 20 is located above the base 40. The ink head unit 20 is located on the inside of the body case 50. The ink head unit 20 is located above the platen 15. As shown in FIG. 5, the ink head unit 20 includes a carriage 22 and an ink head 24. The carriage 22 is engaged with the guide rail 18. The carriage 22 moves in the main scanning direction Y along the guide rail 18. The ink head 24 includes a nozzle (not shown) that discharges ink onto the recording medium 5 placed on the platen 15. The ink head 24 prints a specified image on the recording medium 5. The ink head 24 is mounted on the carriage 22. The ink head 24 moves in the main scanning direction Y along with movement of the carriage 22.

As shown in FIG. 2, the cutting head unit 25 is located above the base 40. The cutting head unit 25 is located on the inside of the body case 50. The cutting head unit 25 is located above the platen 15. The cutting head unit 25 is located on a left side of the ink head unit 20. As shown in FIG. 2, the cutting head unit 25 includes a carriage 27 and a cutting head 29 including a cutter (not shown). The carriage 27 is engaged with the guide rail 18. The carriage 27 moves in the main scanning direction Y along the guide rail 18. The cutter cuts the recording medium 5 placed on the platen 15. The cutting head 29 is mounted on the carriage 27. The cutting head 29 moves in the main scanning direction Y along with movement of the carriage 27. In the present preferred embodiment, the carriage 22 of the ink head unit 20 and the carriage 27 of the cutting head unit 25 integrally move together. In addition, the carriage 27 is movable independently from the carriage 22.

As shown in FIG. 2, the printer 10 includes a carriage mover 30. The carriage mover 30 moves the carriage 22 of the ink head unit 20 and the carriage 27 of the cutting head unit 25 in the main scanning direction Y with respect to the recording medium 5 placed on the platen 15. The carriage mover 30 moves the carriage 22 and the carriage 27 in the main scanning direction Y. Note that a configuration of the carriage mover 30 is not particularly limited. The carriage mover 30 includes a first pulley 31, a second pulley 32, an endless belt 33, and a carriage motor 34. The first pulley 31 is located on a left end of the guide rail 18. The second pulley 32 is located on a right end of the guide rail 18. The belt 33 is wound around the first pulley 31 and the second pulley 32. The belt 33 is fixed to an upper portion of a back surface of the carriage 27. The carriage motor 34 is coupled to the second pulley 32. Alternatively, the carriage motor 34 may be coupled to the first pulley 31. When the carriage motor 34 is driven and the second pulley 32 rotates, the belt 33 moves between the first pulley 31 and the second pulley 32. Consequently, the carriage 22 and the carriage 27 move in the main scanning direction Y.

As shown in FIG. 2, the printer 10 includes a medium mover 35. The medium mover 35 moves the recording medium 5 placed on the platen 15 in the secondary scanning direction X relative to the ink head unit 20 and the cutting head unit 25. The medium mover 35 moves the recording medium 5 placed on the platen 15 in the secondary scanning direction X. The medium mover 35 includes a plurality grit rollers 36, a plurality of pinch rollers 37, and a holding shaft 38.

As shown in FIG. 2, the grit rollers 36 are provided in the platen 15. The grit rollers 36 are embedded in the platen 15 such that upper portions of the grit rollers 36 are exposed to the outside. The grit rollers 36 are aligned in the main scanning direction Y. Each of the grit rollers 36 is located below the pinch roller 37. The recording medium 5 is held between each of the grit rollers 36 and a corresponding one of the pinch rollers 37. When a feed motor (not shown) coupled to the grit rollers 36 is driven and the grit rollers 36 rotate in a state where the recording medium 5 is held between the grit rollers 36 and the pinch rollers 37, the recording medium 5 is conveyed in the secondary scanning direction X.

As shown in FIG. 2, the pinch rollers 37 are located above the platen 15. The pinch rollers 37 are located below the guide rail 18. Each of the pinch rollers 37 is located at a position opposing a corresponding one of the grit rollers 36. The pinch rollers 37 press the recording medium 5 placed on the platen 15 from above.

As shown in FIG. 2, the holding shaft 38 extends in the main scanning direction Y. The holding shaft 38 supports the pinch rollers 37. When the holding shaft 38 rotates about an axis thereof, each of the pinch rollers 37 is able to approach/separate from a corresponding one of the grit rollers 36. The holding shaft 38 is located above the platen 15. The holding shaft 38 is rotatably supported by the base 40.

As shown in FIG. 1, the printer 10 includes a loading lever 45. The loading lever 45 is manually operated by the worker. The loading lever 45 causes the holding shaft 38 (see FIG. 2) to pivot such that each of the pinch rollers 37 (see FIG. 2) approaches/separates from a corresponding one of the grit rollers 36 (see FIG. 2). The loading lever 45 is attached to the base 40. The loading lever 45 includes a first loading lever 46 and a second loading lever 47 (see FIG. 3). The first loading lever 46 and the second loading lever 47 are coupled to a linkage (not shown) that is coupled to the holding shaft 38. The second loading lever 47 is an example of the lever.

As shown in FIG. 2, the first loading lever 46 is located in front of the platen 15. The first loading lever 46 is located on a right side of the platen 15 and a left side of the front right cover 54R. For example, when the first loading lever 46 is pressed downward from a first reference position to a first fixed position, the holding shaft 38 rotates, and the pinch rollers 37 approach the grit rollers 36. When the first loading lever 46 is pressed upward from the first fixed position to the first reference position, the holding shaft 38 rotates, and the pinch rollers 37 separate from the grit rollers 36.

As shown in FIG. 4, the second loading lever 47 is located at the rear of the platen 15. The second loading lever 47 is located on the right side of the platen 15 and a left side of the lower right rear wall 56C. For example, when the second loading lever 47 is pressed downward from a second reference position to a second fixed position, the holding shaft 38 rotates, and the pinch rollers 37 approach the grit rollers 36. When the second loading lever 47 is pressed upward from the second fixed position to the second reference position, the holding shaft 38 rotates, and the pinch rollers 37 separate from the grit rollers 36.

As shown in FIG. 4, the printer 10 includes a first holder 95 and a second holder 96 that hold the recording medium 5, which is wound in the roll shape, in such a manner as to allow rotation thereof. The first holder 95 is located on a left side of the second holder 96. The first holder 95 and the second holder 96 are located at the rear of the platen 15. The first holder 95 and the second holder 96 are located below the body case 50. The first holder 95 and the second holder 96 are slidable on a slide bar 97 that extends in the main scanning direction Y. The first holder 95 and the second holder 96 are able to change positions thereof in the main scanning direction Y along the slide bar 97. The slide bar 97 is supported by the left leg 16L and the right leg 16R. Note that, in FIG. 2, the first holder 95 and the second holder 96 are not shown.

As shown in FIG. 2, the platen 15 supports the recording medium 5 at the time of printing on the recording medium 5. The recording medium 5 is placed on the platen 15. The platen 15 extends in the main scanning direction Y and the secondary scanning direction X. A length of the platen 15 in the main scanning direction Y is longer than a length of the platen 15 in the secondary scanning direction X. The platen 15 is located on the base 40. The platen 15 is located in a central portion of the base 40. As shown in FIG. 5, an upper surface 15H of the platen 15 has a flat or substantially flat shape, for example. The upper surface 15H is a placement surface on which the recording medium 5 is placed. The upper surface 15H defines a portion of a movement path of the recording medium 5.

As shown in FIG. 5, the platen 15 includes a plurality of vacuum holes 15A, each of which penetrates the upper surface 15H in the vertical direction. The vacuum holes 15A are located on a downstream side of the grit rollers 36 in the secondary scanning direction X. Air is suctioned through the vacuum holes 15A when a fan 15B, which will be described below, is driven. When the fan 15B is driven, a negative pressure is generated in an internal space 15C of the platen 15. The recording medium 5 is adhered onto the vacuum holes 15A by the negative pressure generated in the internal space 15C. The vacuum holes 15A adhere the recording medium 5 thereto.

As shown in FIG. 5, the fan 15B is located below the platen 15. The fan 15B includes a suction hole 15BA through which the air is suctioned via the vacuum holes 15A, and a discharge hole 15BB from which the air suctioned from the suction hole 15BA is discharged. The suction hole 15BA opens upward. The discharge hole 15BB opens to a downstream side (the rear herein) in the secondary scanning direction X. The discharge hole 15BB opens to an upstream guide 70. When the fan 15B is driven, as indicated by arrows F1 in FIG. 5, the air is suctioned into the fan 15B via the vacuum holes 15A and the suction hole 15BA. Then, as indicated by an arrow F2 in FIG. 5, the air that is discharged from the discharge hole 15BB of the fan 15B flows toward the upstream guide 70. Thereafter, as indicated by an arrow F3 in FIG. 5, the air is discharged to the outside of the printer 10 via a discharge port 78, which is located in the upstream guide 70 and will be described below. Note that, because the recording medium 5 is not provided ahead of the airflow, a problem of the recording medium 5 floating or the like does not occur.

As shown in FIG. 5, the printer 10 includes the upstream guide 70. The upstream guide 70 is an example of the guide. The upstream guide 70 is located on the upstream side of (at the rear of) the platen 15 in the secondary scanning direction X. The upstream guide 70 is supported by the base 40. When the recording medium 5 moves from the upstream side to the downstream side, the upstream guide 70 guides the recording medium 5 to the platen 15. When the recording medium 5 moves from the downstream side to the upstream side, the upstream guide 70 guides the recording medium 5 guided from the platen 15.

As shown in FIG. 5, an upper surface 70A of the upstream guide 70 is tilted obliquely downward from the downstream side to the upstream side in the secondary scanning direction X. The upper surface 70A has an arcuate or a substantially arcuate shape when seen in the main scanning direction Y. The upstream guide 70 includes a first portion 71 that is coupled to a rear end 15R of the platen 15, a second portion 72 that extends obliquely downward to the front from a lower end of the first portion 71, a third portion 73 that extends downward from a lower end of the second portion 72, and a fourth portion 74 that extends forward from a lower end of the third portion 73. The first portion 71 extends obliquely downward from the downstream side to the upstream side in the secondary scanning direction X. The second portion 72 extends obliquely downward from the upstream side to the downstream side in the secondary scanning direction X. The fourth portion 74 extends in the secondary scanning direction X. The first portion 71 guides the recording medium 5. The first portion 71 defines a portion of the movement path of the recording medium 5. A front end of the fourth portion 74 is coupled to the base 40. The upstream guide 70 includes the discharge port 78 that penetrates the fourth portion 74 in the vertical direction.

Figure 6:
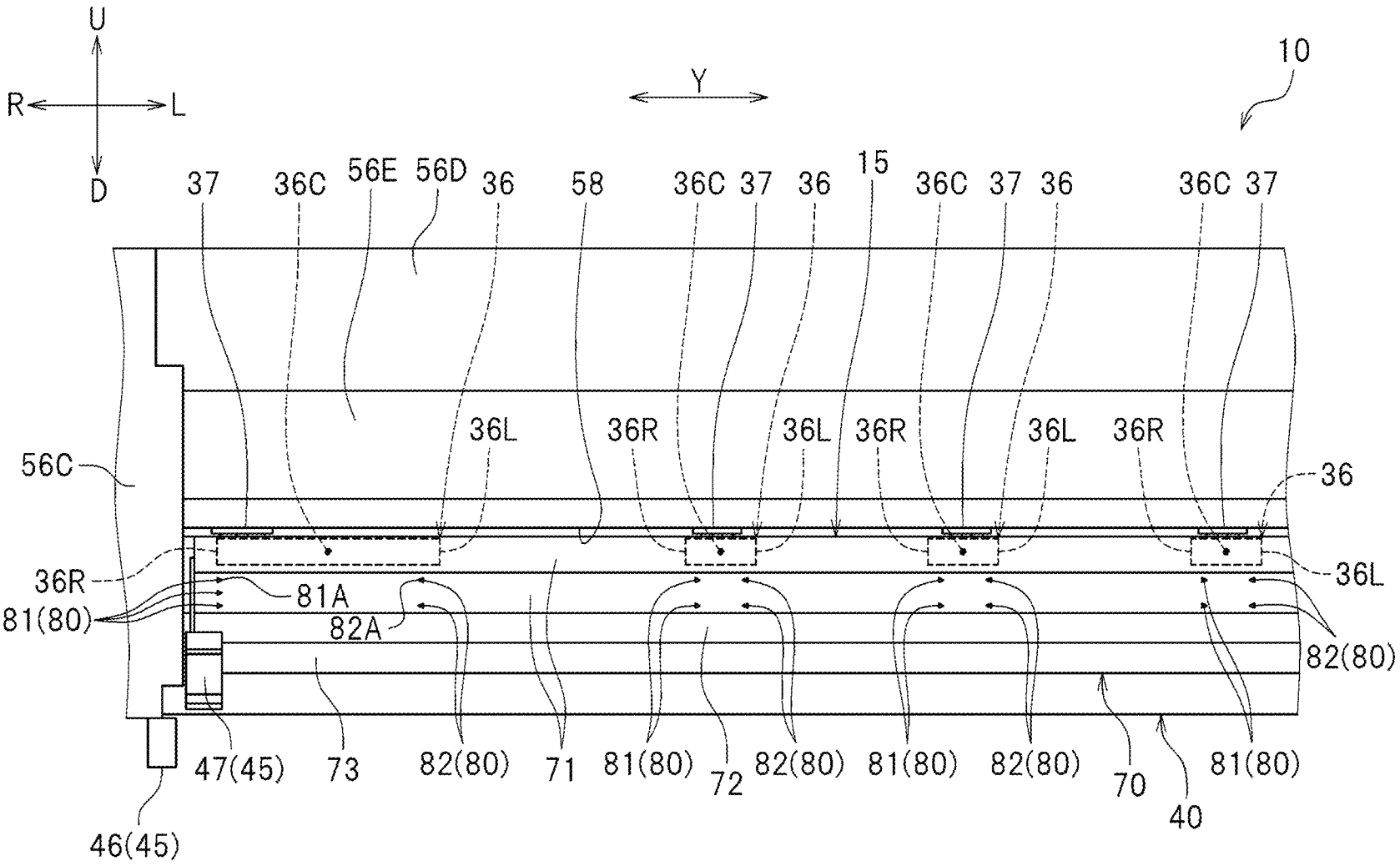
FIG. 6 is a rear view in which a portion of the printer according to a preferred embodiment is enlarged.
Figure 8:
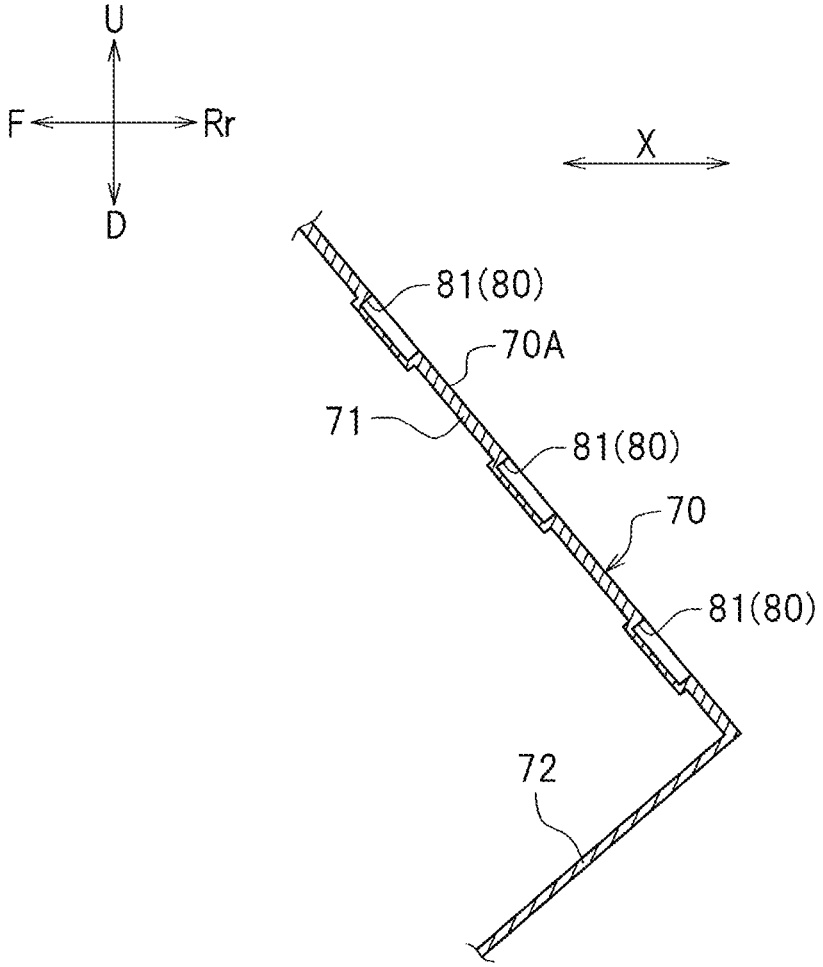
FIG. 8 is a cross-sectional view taken along line VIII-VIII in FIG. 7.

As shown in FIG. 6, the upstream guide 70 includes a plurality of concave recesses 80. The concave recesses 80 are provided for each of the grit rollers 36. For example, in the case in which eight grit rollers 36 are provided, the concave recesses 80 are provided for each of the respective grit rollers 36. As shown in FIG. 8, the concave recesses 80 are recessed from the upper surface 70A of the upstream guide 70. The concave recesses 80 are recessed obliquely downward to the front from the upper surface 70A. The concave recesses 80 are provided in the first portion 71 of the upstream guide 70. The concave recesses 80 may be made by pressing the upstream guide 70, for example.

As shown in FIG. 6, each of the concave recesses 80 indicates the position of a corresponding one of the grit rollers 36 in the main scanning direction Y. That is, the grit rollers 36 are located on the downstream side of the concave recesses 80 in the secondary scanning direction X. Each of the concave recesses 80 includes a first concave recess 81 and a second concave recess 82. For example, the first concave recess 81 is located toward a second end (a left end 36L herein) from a first end (a right end 36R herein) of the grit roller 36. For example, the first concave recess 81 is located on a right side of a center 36C of the grit roller 36 in the main scanning direction Y. The first concave recess 81 indicates a first position at the first end (the right end 36R herein) in the main scanning direction Y of the grit roller 36. That is, the grit roller 36 is located on the downstream side of the first concave recess 81 in the secondary scanning direction X. For example, the first position may be located at a position that is spaced apart from the right end 36R of the grit roller 36 to the left at a specified distance (for example, about 5 mm to about 20 mm). Note that the first position may be located at the right end 36R of the grit roller 36. For example, the second concave recess 82 is located toward the first end (the right end 36R herein) from the second end (the left end 36L herein) of the grit roller 36. For example, the second concave recess 82 is located on a left side of the center 36C of the grit roller 36 in the main scanning direction Y. The second concave recess 82 indicates a second position on the second end (the left end 36L herein) in the main scanning direction Y of the grit roller 36. That is, the grit roller 36 is located on the downstream side of the second concave recess 82 in the secondary scanning direction X. The second position may be located to the right of a left end 36L of the grit roller 36 at a specified distance (for example, about 5 mm to about 20 mm). Note that the second position may be located at or aligned with the left end 36L of the grit roller 36.

Figure 7:
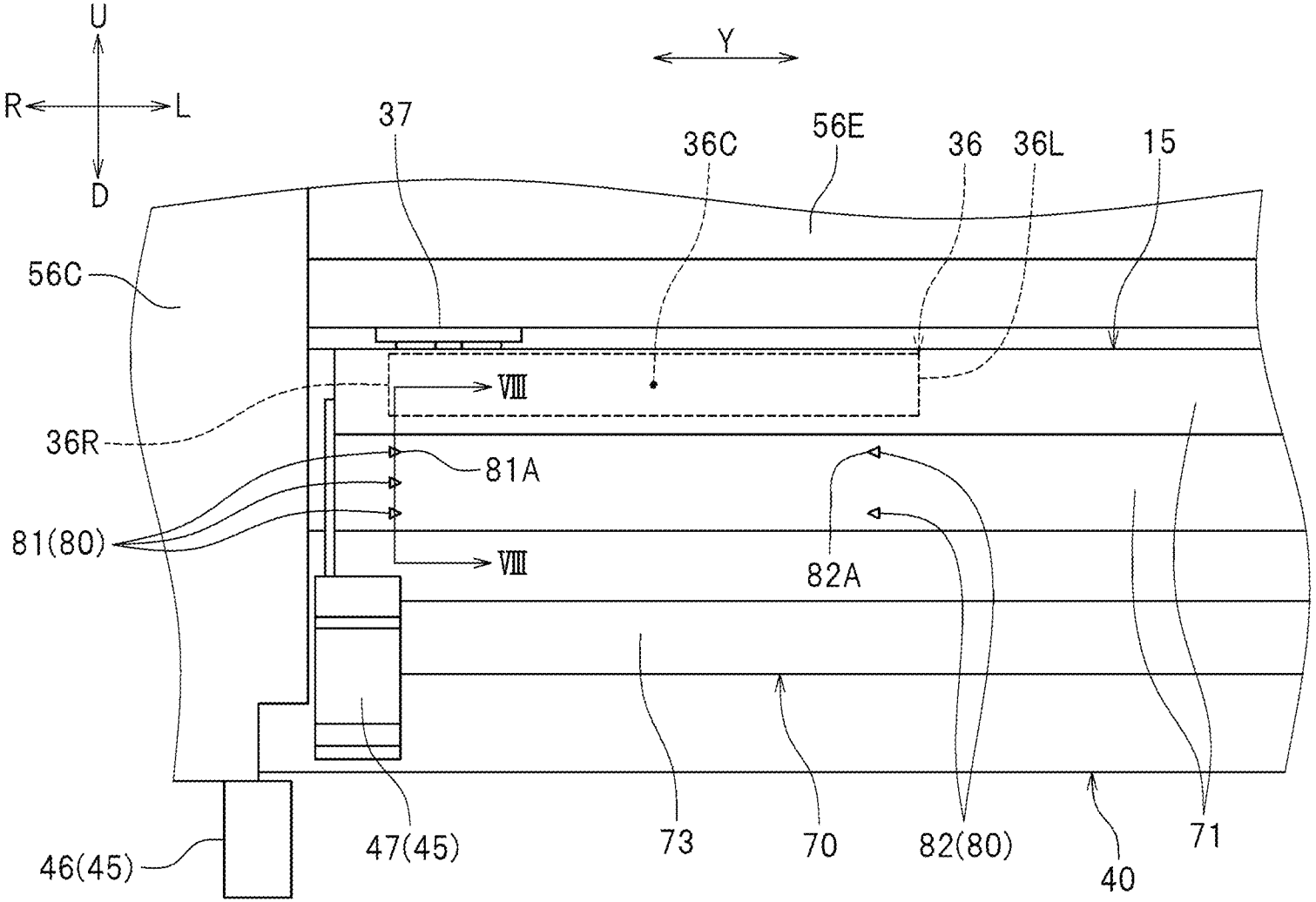
FIG. 7 is a rear view in which a portion of an upstream guide according to a preferred embodiment of the present invention is enlarged.

As shown in FIG. 7, each of the first concave recess 81 and the second concave recess 82 may have a triangular or substantially triangular shape, for example. A normal (a line perpendicular to the base of the triangle) of the first triangular concave recess 81 that passes through an apex 81A of the first concave recess 81 is parallel or substantially parallel to the main scanning direction Y, for example. A normal of the second triangular concave recess 82 that passes through an apex 82A of the second concave recess 82 is parallel or substantially parallel to the main scanning direction Y, for example. The apex 81A of the first concave recess 81 preferably opposes the apex 82A of the second concave recess 82. That is, the normal of the first concave recess 81 preferably overlaps the normal of the second concave recess 82. For example, the apex 81A of the first concave recess 81 indicates a start point, at which the recording medium 5 is to be placed, for the grit roller 36. Meanwhile, the apex 82A of the second concave recess 82 indicates an end point, at which the recording medium 5 is to be placed, for the grit roller 36. When seen from the upstream side in the secondary scanning direction X (that is, when the printer 10 is seen from behind), the first concave recess 81 and the second concave recess 82 are located above the second loading lever 47. When seen from the upstream side in the secondary scanning direction X, the first concave recess 81 and the second concave recess 82 are located below the grit roller 36.

As shown in FIG. 5, the printer 10 includes a downstream guide 90. The downstream guide 90 is located on the downstream side (in front of) the platen 15 in the secondary scanning direction X. The downstream guide 90 is supported by the base 40. When the recording medium 5 moves from the downstream side to the upstream side, the downstream guide 90 guides the recording medium 5 to the platen 15. When the recording medium 5 moves from the upstream side to the downstream side, the downstream guide 90 guides the recording medium 5 guided from the platen 15.

As shown in FIG. 5, an upper surface 90A of the downstream guide 90 is tilted obliquely downward from the upstream side to the downstream side in the secondary scanning direction X. The upper surface 90A preferably has an arcuate or substantially arcuate shape when seen in the main scanning direction Y. The downstream guide 90 includes a first portion 91 that is coupled to a front end 15F of the platen 15, and a second portion 92 that extends obliquely downward to the rear from a lower end of the first portion 91. The first portion 91 extends obliquely downward from the upstream side to the downstream side in the secondary scanning direction X. The second portion 92 extends obliquely downward from the downstream side to the upstream side in the secondary scanning direction X. The first portion 91 guides the recording medium 5. The first portion 91 defines a portion of the movement path of the recording medium 5. A lower end of the second portion 92 is coupled to the base 40.

As has been described so far, the concave recesses 80 are provided on the upper surface 70A of the upstream guide 70 located on the upstream side of the platen 15 in the secondary scanning direction X. Each of the concave recesses 80 indicates a position of a corresponding one of the grit rollers 36 in the main scanning direction Y. Thus, even in the case in which the positions of the grit rollers 36 cannot directly be recognized visually from the rear side of the printer 10, the worker is able to check the positions of the concave recesses 80 and easily recognize the positions of the grit rollers 36. In this way, the worker is able to reliably place the recording medium 5 on the grit rollers 36. In addition, the concave recesses 80 are recessed from the upper surface 70A of the upstream guide 70. Thus, in the case in which the recording medium 5 moves from the upstream side to the downstream side in the secondary scanning direction X on the upper surface 70A of the upstream guide 70, or in the case in which the recording medium 5 moves from the downstream side to the upstream side in the secondary scanning direction X on the upper surface 70A of the upstream guide 70, a front end or a rear end of the recording medium 5 is not caught by or stuck in the concave recesses 80. Thus, smooth movement of the recording medium 5 is not hindered.

According to a preferred embodiment of the present invention, each of the concave recesses 80 includes the first concave recess 81 that indicates the first position on the right end 36R in the main scanning direction Y of the grit roller 36; and the second concave recess 82 that indicates the second position on the left end 36L in the main scanning direction Y of the grit roller 36. In this way, the position of each of the grit rollers 36 is further clarified. Thus, the worker is able to reliably place the recording medium 5 on the grit rollers 36 based on the positions of the first concave recesses 81 and the second concave recesses 82.

According to a preferred embodiment of the present invention, the first concave recess 81 is located to the left of the right end 36R in the main scanning direction Y of the grit roller 36, and the second concave recess 82 is located to the right of the left end 36L in the main scanning direction Y of the grit roller 36. For example, in the case in which the grit roller 36 has a suitable portion to place the end of the recording medium 5 in the main scanning direction Y (for example, having a larger gripping force for the recording medium 5), the first concave recess 81 and the second concave recess 82 are located near both ends of such a portion. In this way, the worker is able to place the end of the recording medium 5 at the suitable position on the grit roller 36.

According to a preferred embodiment of the present invention, each of the first concave recess 81 and the second concave recess 82 preferably has a triangular or substantially triangular shape, and the apex 81A of the first concave recess 81 opposes the apex 82A of the second concave recess 82. In this way, the worker is able to further easily recognize that the grit roller 36 is located between the apex 81A of the first concave recess 81 and the apex 82A of the second concave recess 82.

According to a preferred embodiment of the present invention, when seen from the upstream side in the secondary scanning direction X, the first concave recess 81 and the second concave recess 82 are located above the second loading lever 47. Thus, the first concave recess 81 and the second concave recess 82 are located even further closer to each of the grit rollers 36. For this reason, the worker is able to further easily check the positions of the grit rollers 36.

The printer 10 according to a preferred embodiment of the present invention preferably includes the cutting head 29 including the cutter that moves in the main scanning direction Y and cuts the recording medium 5 placed on the platen 15. When the recording medium 5 is cut by the cutter, a frequency of the movement of the recording medium 5 from the upstream side to the downstream side in the secondary scanning direction X and from the downstream side to the upstream side in the secondary scanning direction X by the grit rollers 36 is larger than a case in which the ink head 24 is used to print on the recording medium 5. Accordingly, when the recording medium 5 moves from the downstream side to the upstream side in the secondary scanning direction X, the rear end of the recording medium 5 is possibly stuck on the concave recesses 80. However, since the concave recesses 80 are recessed from the upper surface 70A of the upstream guide 70 in the present preferred embodiment, the recording medium 5 moves smoothly.

The description has been made so far of preferred embodiments of the present invention. It should be noted that the above-described preferred embodiments are merely illustrative, and the present invention can be implemented in various other modes.

In the above-described preferred embodiments, each of the first concave recess 81 and the second concave recess 82 preferably has a triangular or substantially triangular shape. However, the shapes of the first concave recess 81 and the second concave recess 82 are not limited thereto. For example, each of the first concave recess 81 and the second concave recess 82 may have a shape of an arrow or a symbol (for example, "+", "<", ">", or the like). Alternatively, each of the first concave recess 81 and the second concave recess 82 may have a circular or substantially circular shape, an oval shape, or a rectangular shape.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer comprising:

a platen that receives a recording medium thereon;

an ink head including a nozzle that discharges ink onto the recording medium placed on the platen and that moves in a main scanning direction;

a guide located on an upstream side of the platen in a secondary scanning direction perpendicular to the main scanning direction and that guides the recording medium toward the ink head, the guide including an upper surface tilted obliquely downward from a downstream side of the platen to the upstream side of the platen in the secondary scanning direction; and a grit roller provided in the platen and that moves the recording medium placed on the platen in the secondary scanning direction; wherein the guide includes at least one concave recess that is recessed from the upper surface of the guide;

the at least one concave recess indicates a position of the grit roller in the main scanning direction;

the at least one concave recess includes a first concave recess and a second concave recess;

the first concave recess indicates a first position at a first end of the grit roller in the main scanning direction; and the second concave recess indicates a second position at a second end of the grit roller in the main scanning direction.

2. The inkjet printer according to claim 1, wherein the first concave recess is located between the first end of the grit roller and the second end of the grit roller in the main scanning direction; and the second concave recess is located between the first end of the grit roller and the second end of the grit roller in the main scanning direction.

3. The inkjet printer according to claim 1, wherein each of the first concave recess and the second concave recess has a triangular shape; and an apex of the first concave recess opposes an apex of the second concave recess.

4. The inkjet printer according to claim 1, further comprising:

a pinch roller located above the grit roller and that holds the recording medium between the pinch roller and the grit roller;

a holding shaft that supports the pinch roller; and a lever that controls the holding shaft to pivot and move the pinch roller away from or towards the grit roller; wherein when seen from the upstream side in the secondary scanning direction, the first concave recess and the second concave recess are located above the lever.

5. An inkjet printer comprising:

the inkjet printer according to claim 1; and a cutting head; wherein the cutting head includes a cutter that moves in the main scanning direction to cut the recording medium on the platen.

6. The inkjet printer according to claim 1, further comprising:

a second grit roller spaced apart from the grit roller in the main scanning direction; wherein the at least one concave recess further includes a third concave recess and a fourth concave recess;

the third concave recess indicates a first position at a first end of the second grit roller in the main scanning direction; and the fourth concave recess indicates a second position at a second end of the second grit roller in the main scanning direction.

* * * * *